US011970834B2

(12) United States Patent
Ishikawa et al.

(10) Patent No.: US 11,970,834 B2
(45) Date of Patent: Apr. 30, 2024

(54) WORK MACHINE

(71) Applicant: Komatsu Ltd., Tokyo (JP)

(72) Inventors: Ryo Ishikawa, Tokyo (JP); Kazuhiro Kurihara, Tokyo (JP); Takeshi Endou, Tokyo (JP)

(73) Assignee: Komatsu Ltd., Tokyo (JP)

( * ) Notice: Subject to any disclaimer, the term of this patent is extended or adjusted under 35 U.S.C. 154(b) by 264 days.

(21) Appl. No.: 17/285,506

(22) PCT Filed: Jun. 12, 2020

(86) PCT No.: PCT/JP2020/023226
§ 371 (c)(1),
(2) Date: Apr. 15, 2021

(87) PCT Pub. No.: WO2020/251023
PCT Pub. Date: Dec. 17, 2020

(65) Prior Publication Data

US 2021/0381193 A1 Dec. 9, 2021

(30) Foreign Application Priority Data

Jun. 14, 2019 (JP) ..... 2019-111371

(51) Int. Cl.
*E02F 3/38* (2006.01)
*E02F 3/32* (2006.01)
*E02F 3/42* (2006.01)

(52) U.S. Cl.
CPC ..... *E02F 3/38* (2013.01); *E02F 3/325* (2013.01); *E02F 3/425* (2013.01)

(58) Field of Classification Search
None
See application file for complete search history.

(56) References Cited

U.S. PATENT DOCUMENTS

| | | | | |
|---|---|---|---|---|
| 8,991,029 | B2 * | 3/2015 | Yelistratov | E02F 3/38 414/722 |
| 9,662,746 | B2 * | 5/2017 | Ulrich | B23K 31/02 |
| 10,519,622 | B2 * | 12/2019 | Caillieret | E02F 3/425 |
| 10,767,340 | B2 * | 9/2020 | Amaya | B66C 23/702 |
| 2005/0204590 | A1 | 9/2005 | Takano et al. | |
| 2009/0057049 | A1 | 3/2009 | Yamada et al. | |
| 2013/0140927 | A1 | 6/2013 | Murata et al. | |

FOREIGN PATENT DOCUMENTS

| | | | |
|---|---|---|---|
| CN | 1673465 | A | 9/2005 |
| CN | 101490425 | A | 7/2009 |
| CN | 103081306 | A | 5/2013 |

(Continued)

*Primary Examiner* — Michael S Lowe
(74) *Attorney, Agent, or Firm* — Locke Lord LLP

(57) ABSTRACT

The invention includes a vehicle main body, a boom, a first actuator connecting the boom and the vehicle main body and configured to rotate the boom with respect to the vehicle main body about a first central axis, a first electric motor connected to the first actuator and that operates the first actuator. The boom includes a pair of boom lateral plates disposed to face each other in a direction of the first central axis, and a boom bottom plate connecting the boom lateral plates to each other, the first electric motor being disposed in a boom internal space surrounded by the pair of boom lateral plates and the boom bottom plate.

14 Claims, 6 Drawing Sheets

(56) References Cited

FOREIGN PATENT DOCUMENTS

| | | | |
|---|---|---|---|
| EP | 3647627 | A1 | 5/2020 |
| JP | H03-020364 | Y2 | 5/1991 |
| JP | H10-018335 | A | 1/1998 |
| JP | 2000-273904 | A | 10/2000 |
| JP | 2001-233584 | A | 8/2001 |
| JP | 2003-082707 | A | 3/2003 |
| JP | 2019-011571 | A | 1/2019 |

* cited by examiner

WORK MACHINE

TECHNICAL FIELD

The present invention relates to a work machine.

Priority is claimed on Japanese Patent Application No. 2019-111371, filed Jun. 14, 2019, the content of which is incorporated herein by reference.

BACKGROUND ART

Patent Document 1 discloses an electric excavator as an example of a work machine. The electric excavator includes an undercarriage and an upper swing body. The upper swing body is provided with a boom, an arm, and a bucket (work tool). The boom, arm, and bucket are driven by an electric motor and an electric cylinder.

CITATION LIST

Patent Literature

[Patent Document 1] Japanese Unexamined Patent Application Publication No. 2003-82707

DISCLOSURE OF INVENTION

Technical Problem

In such a work machine, the electric motor provided in the boom is provided so as to be exposed to the outside of the boom. Therefore, the electric motor may receive an impact from the outside.

The present invention has been made in view of such a problem and the object is to provide a work machine having high reliability.

Solution to Problem

The present invention according to one aspect of the work machine includes: a vehicle main body; a boom that has a base end portion supported by the vehicle main body and that extends from the vehicle main body; a first actuator that connects the boom and the vehicle main body and is configured to rotate the boom with respect to the vehicle main body about a first central axis intersecting with an extending direction of the boom; and a first electric motor that is connected to the first actuator to operate the first actuator, wherein the boom comprises: a pair of boom lateral plates that is disposed to face each other in a direction of the first central axis; and a boom bottom plate that connects the boom lateral plates to each other, wherein the first electric motor is disposed in a boom internal space surrounded by the pair of boom lateral plates and the boom bottom plate.

Advantageous Effects of Invention

According to the work machine of the above aspect, it is possible to avoid an impact on the electric motor, and high reliability is achieved.

EMBODIMENT FOR CARRYING OUT THE INVENTION

Hereinafter, the embodiment of present invention will be described in detail with reference to FIG. 1 to FIG. 6.

<Excavator (Work Machine)>

Figure 1:
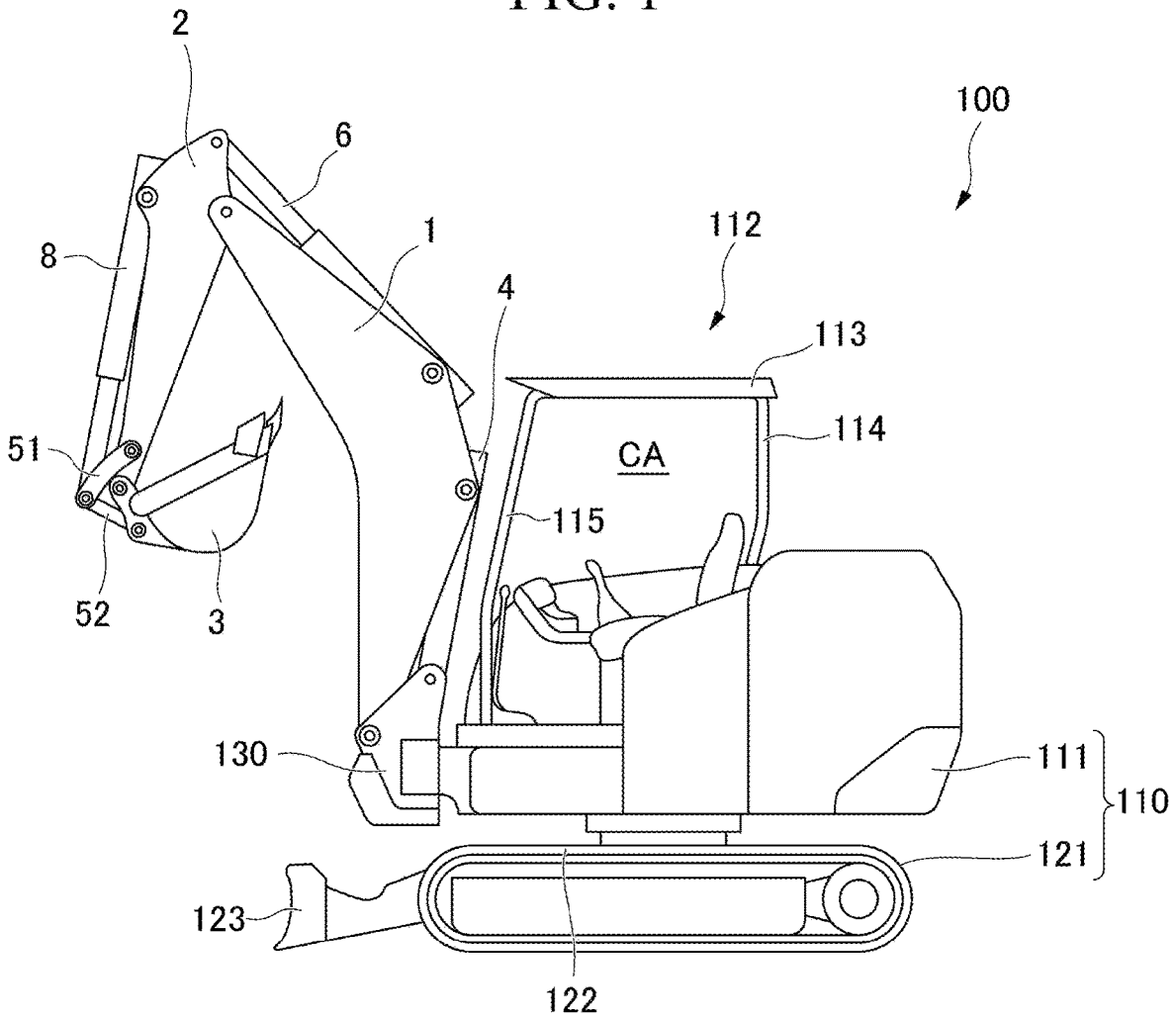
FIG. 1 is an entire side view of an excavator related to an embodiment of the present invention.

As shown in the FIG. 1, an excavator 100 as a work machine includes a vehicle main body 110, a boom 1, an arm 2, and a bucket (work tool) 3. The excavator 100 further includes a first actuator 4 and a first electric motor 5 that operate the boom 1, a second actuator 6 and a second electric motor 7 that operate the arm 2, and a third actuator 8 and a third electric motor 9 that operate the bucket 3.

<Vehicle Main Body>

The vehicle main body 110 includes an undercarriage 121 and an upper swing body 111. Hereinafter, a direction in which gravity acts in a state in which the excavator 100 is disposed in a horizontal surface is referred to as a "vertical direction".

The undercarriage 121 has a pair of right and left crawler belts 122. For example, the undercarriage 121 is capable of traveling by driving the crawler belts 122 by an electric motor (not shown). A hydraulic motor may be used instead of the electric motor. On a front portion of the undercarriage 121, a blade 123 as a dump plate extending in a vehicle width direction of the undercarriage 121 (hereinafter, simply referred to as a "width direction") is provided. A height position of the blade 123 is capable of being adjusted using, for example, an electric actuator.

The upper swing body 111 is the upper portion of undercarriage 121. In the upper swing body 111, the above-described electric motor for traveling, and a battery and an inverter serving as a power source of the electric motor for traveling are installed. The upper swing body 111 is capable of swinging about an axis extending in the vertical direction with respect to the undercarriage 121.

The upper swing body 111 is provided with a canopy 112. The canopy 112 forms a driving space CA. That is, the canopy 112 includes: a hood 113 that forms a ceiling portion of the driving space CA; a rear support 114 that is provided on a rear portion of the hood 113 and that extends downward from the hood 113; and a front support 115 that is provided on a front portion of the hood 113 and that extends downward from the hood 113. A pair of the front supports 115 and a pair of the rear supports 114 are each provided at positions separated from each other in the width direction.

Here, regardless of a traveling direction of the undercarriage 121, a front and rear of an operator is referred to as "forward-rearward directions" of the upper swing body 111. The vehicle width direction intersecting the forward-rearward directions is referred to as a "width direction".

Figure 2:
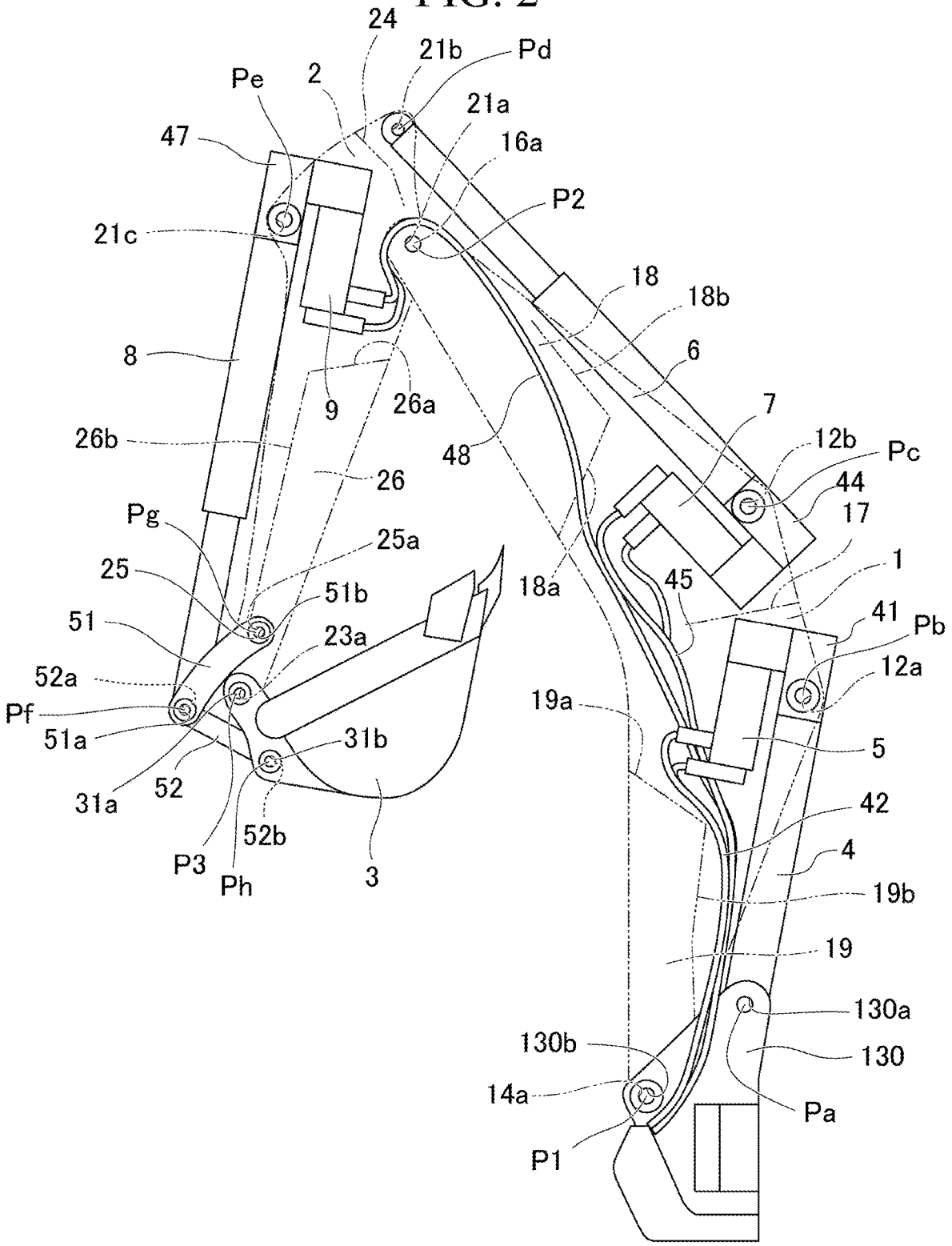
FIG. 2 is a side view of a boom, an arm, and a bucket of the excavator according to the embodiment of the present invention and a view showing insides of the boom and the arm in a transparent manner.

As shown in FIG. 1 and FIG. 2, a front portion of the upper swing body 111 is provided with a bracket 130 for supporting the boom 1. As shown in FIG. 2, the bracket 130 is provided with a first hole 130*a* extending in the width direction of the upper swing body 111 and a second hole 130*b* disposed below and in front of the first hole 130*a* and extending in parallel with the first hole 130*a*.

<Boom>

Figure 3:
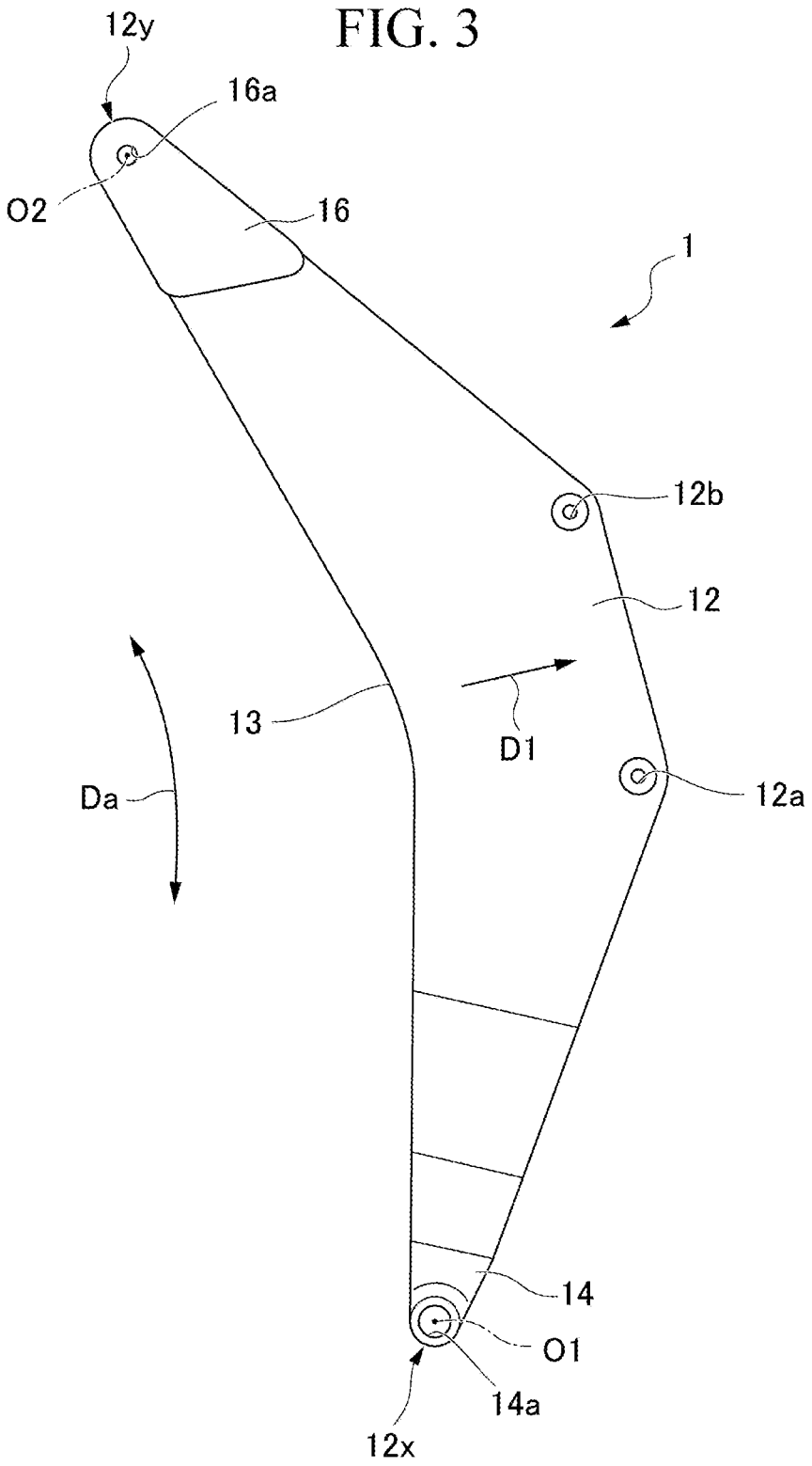
FIG. 3 is a side view of the boom of the excavator of the embodiment of the present invention.
Figure 4:
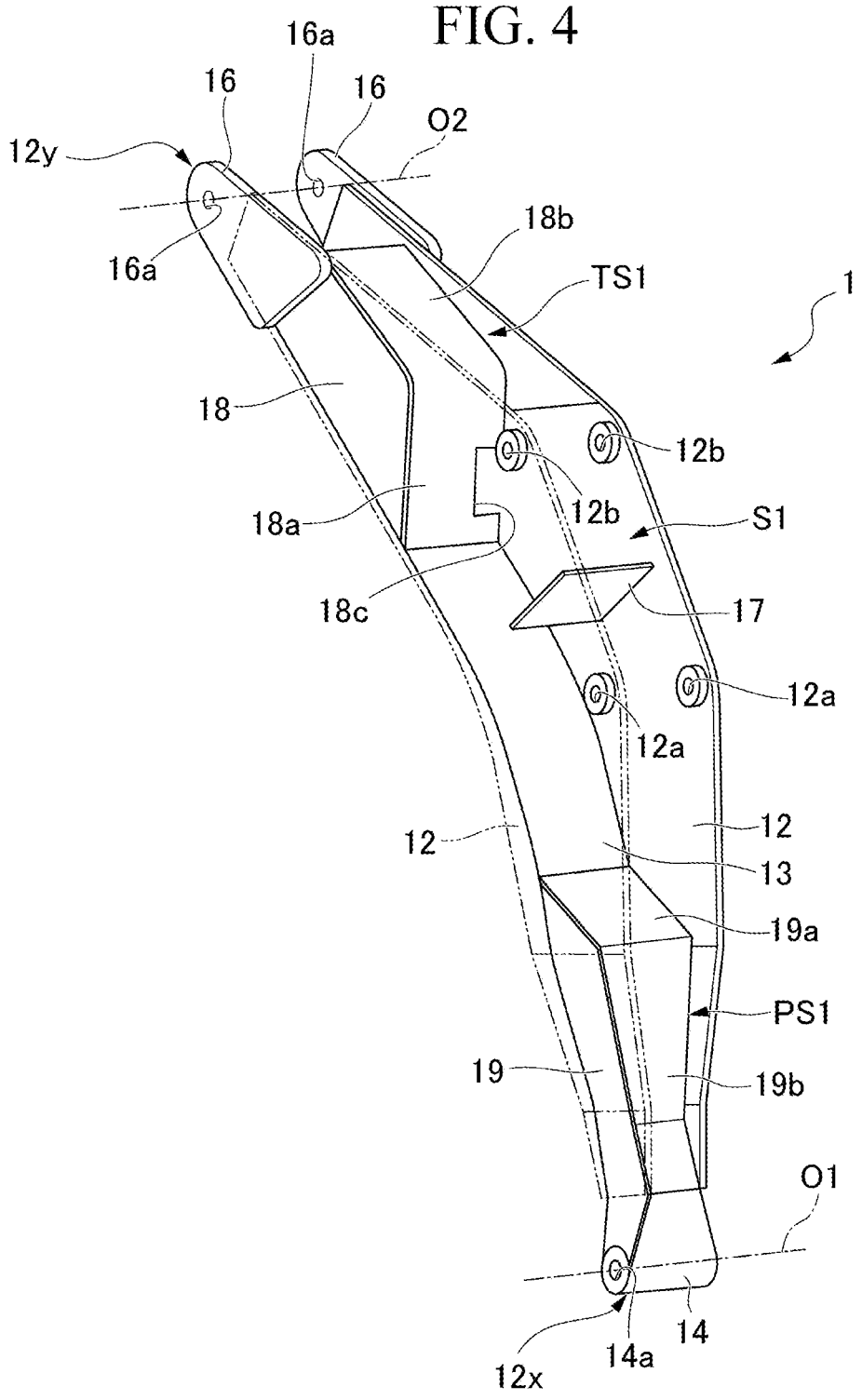
FIG. 4 is a perspective view of the boom of the excavator according to the embodiment of the present invention and a view showing an inside of the boom in a transparent manner.

As shown in FIG. 2 to FIG. 4, the boom 1 includes: a pair of boom lateral plates 12; a boom bottom plate 13 that connects the pair of boom lateral plates 12; a boom support portion 14 that supports the boom lateral plates 12 and the boom bottom plate 13 on the vehicle main body 110; and an arm support portion 16 that is provided on each boom lateral plate 12 and that supports the arm 2. The boom 1 further includes a boom partition member 17 that connects the pair of boom lateral plates 12 to each other.

<Boom Support Portion>

As shown in FIG. 2 to FIG. 4, the boom support portion 14 is provided on the base end portion of the boom 1. The boom support portion 14 is provided with a first through hole 14*a* penetrating in the width direction of the upper swing body 111. A first pin P1 extending in the width direction is inserted into the first through hole 14*a*. A rotation center of the first pin P1 is defined as a first central axis O1. The first pin P1 is inserted into the second hole 130*b* of the bracket 130 of the vehicle main body 110; thereby the boom support portion 14 is supported so as to be rotatable about the first central axis O1 with respect to the upper swing body 111.

<Boom Lateral Plate>

As shown in FIG. 4, the pair of boom lateral plates 12 are disposed to face each other at an interval in the direction of the first central axis O1, that is, in the width direction of the upper swing body 111. In addition, as shown in FIG. 3, each boom lateral plate 12 has a shape in which a size (plate width size) in a vertically provided direction from the boom bottom plate 13 gradually increases and then gradually decreases from a base end portion 12*x*, which is a base end portion of the boom 1, toward a tip end portion 12*y*, which is the tip end portion of the boom 1. Therefore, the plate width size is largest at a center portion of the boom lateral plate 12 in an extending direction Da. In addition, the both boom lateral plates 12 extend in parallel to each other from the base end portion 12*x* toward the tip end portion 12*y* as shown in FIG. 4, then bend or curve so as to separate from each other, then bend or curve so as to approach each other, and finally extend in parallel to each other toward the center portion in the extending direction Da and the tip end portion 12*y*.

The base end portion 12*x* of the pair of boom lateral plates 12 are provided integrally with the boom support portion 14, so that each boom lateral plate 12 extends so as to separate from the boom support portion 14.

<Arm Support Portion>

As shown in FIG. 4, the arm support portions 16 are arranged to face each other at intervals in the direction of the first central axis O1, that is, in the width direction of the upper swing body 111. Each of the arm support portions 16 has a plate shape.

As shown in FIG. 3 and FIG. 4, the arm support portion 16 is provided on the tip end portion 12*y* of the boom lateral plate 12. The pair of arm support portions 16 are provided on an outer surface of each boom lateral plate 12 so as to sandwich the pair of boom lateral plates 12. Each of the arm support portions 16 is provided so as to protrude in the extending direction Da of the boom lateral plate 12 from the tip end portion 12*y* of each boom lateral plate 12. A portion of the arm support portion 16 protruding from the boom lateral plate 12 is provided with a second through hole 16*a* penetrating in the width direction of the upper swing body 111. A second pin P2 extending in the width direction is inserted into the second through hole 16*a*. A rotation center of the second pin P2 is defined as a second central axis O2.

<Boom Bottom Plate>

The boom bottom plate 13 has a plate shape as shown in FIG. 4. The boom bottom plate 13 is provided along the extending direction Da of the boom lateral plate 12. As shown in FIG. 3 and FIG. 4, the boom bottom plate 13 connects the pair of boom lateral plates 12. To be specific, the pair of boom lateral plates 12 are provided integrally with the boom bottom plate 13 at both edge portions of the boom bottom plate 13 in the direction in which the first central axis O1 extends, that is, in the width direction. In a state in which the entire boom 1 is disposed along the vertical direction, the boom lateral plate 12 is erected from the boom bottom plate 13 toward the upper swing body 111 side. Hereinafter, a direction in which the boom lateral plate 12 is erected from the boom bottom plate 13 is referred to as a first direction D1. The first direction D1 is a direction intersecting with the extending direction Da. The boom bottom plate 13 is bent or curved so as to be convex toward the first direction D1 at a central portion in the extending direction Da.

As shown in FIG. 4, from the boom bottom plate 13, a tip end convex portion 18 is provided, which protrudes in the vertically provided direction of the boom lateral plates 12, that is, in the first direction D1, on a tip end portion 12*y* side of the boom lateral plate 12, and connects the pair of boom lateral plates 12 to each other. The tip end convex portion 18 is provided integrally with the boom bottom plate 13 and the boom lateral plate 12 by joining a member having a plate shape to the boom bottom plate 13 and the boom lateral plate 12 by welding or the like. Therefore, the tip end convex portion 18 is provided on the boom bottom plate 13 so as to be sandwiched by the pair of boom lateral plates 12.

As shown in FIG. 4, the tip end convex portion 18 is provided with an inclination surface 18*a* at a position close to the central portion in the extending direction Da in the boom bottom plate 13, and the inclination surface 18*a* is inclined toward the tip end portion 12*y* of the boom lateral plate 12 while separating away from the boom bottom plate 13 in the first direction D1. The tip end convex portion 18 further includes an upper surface 18*b* having a flat shape, being bent or curved from the inclination surface 18*a*, and continuously directed to the tip end portion 12*y*.

The upper surface 18*b* of the tip end convex portion 18 is disposed on a side closer to the boom bottom plate 13 than an upper edge portion of the boom lateral plate 12, that is, an edge portion on a side away from the boom bottom plate 13 in the first direction D1. As a result, a tip end-side space TS1 is formed on the first direction D1 side of the upper surface 18*b* by being sandwiched by the upper surface 18*b* of the tip end convex portion 18 and the pair of boom lateral plates 12. In the tip end convex portion 18, a passage 18*c* penetrating in an extending direction of the boom 1 and opening to an inclination surface 18*a* is provided at a position adjacent to one boom lateral plate 12.

Further, from the boom bottom plate 13, a base end convex portion 19 is provided which protrudes in the first direction D1 on the base end portion 12*x* side of the boom lateral plate 12 and connects the pair of boom lateral plates 12 to each other. Therefore, the base end convex portion 19 is provided on the boom bottom plate 13 so as to be sandwiched by the pair of boom lateral plates 12.

As shown in FIG. 4, the base end convex portion 19 is provided with an inclination surface 19*a* at a position close to the central portion in the extending direction Da in the boom bottom plate 13, and the inclination surface 19*a* is inclined toward the base end portion 12*x* of the boom lateral plate 12 while separating away from the boom bottom plate 13 in the first direction D1. The base end convex portion 19 further includes an upper surface 19*b* having a flat shape, being bent or curved from the inclination surface 19*a*, and continuously directed to the base end portion 12*x*. The upper surface 19*b* is disposed on a side closer to the boom bottom plate 13 than the upper edge portion of the boom lateral plate 12, that is, an edge portion on a side away from the boom bottom plate 13 in the first direction D1. As a result, a base end-side space PTS1 is formed on a first direction D1 side of the upper surface 19*b* by being sandwiched by the upper surface 19 of the base end convex portion 19 and the pair of boom lateral plates 12.

Here, a space that is surrounded by the boom bottom plate 13 and the pair of boom lateral plates 12 and that is formed on the first direction D1 side of the boom bottom plate 13 between the inclination surface 18*a* of the tip end convex portion 18 and the inclination surface 19*a* of the base end convex portion 19 is defined as a boom internal space S1. The boom internal space S1 is disposed at a central portion in the extending direction Da of the boom lateral plate 12.

<Boom Partition Member>

The boom partition member 17 has a plate shape as shown in FIG. 4. The boom partition member 17 is disposed in the boom internal space S1 and connects the pair of boom lateral plates 12 to each other. Specifically, the boom partition member 17 is provided at a position separated from the boom bottom plate 13, and partitions the boom internal space S1 in the middle of the extending direction Da. A first actuator hole 12*a* and a second actuator hole 12*b* that penetrate in the width direction of the upper swing body 111 at positions close to the upper edge portion in each of the pair of boom lateral plates 12 are provided on both sides in the extending direction Da with the boom partition member 17 being sandwiched therebetween.

The first actuator hole 12*a* is provided closer to the base end portion 12*x* side of the boom lateral plate 12 than the second actuator hole 12*b*. Central axes of the first actuator hole 12*a* and the second actuator hole 12*b* are provided in parallel with central axes of the first through hole 14*a* and the second through hole 16*a*.

<Arm>

Figure 5:
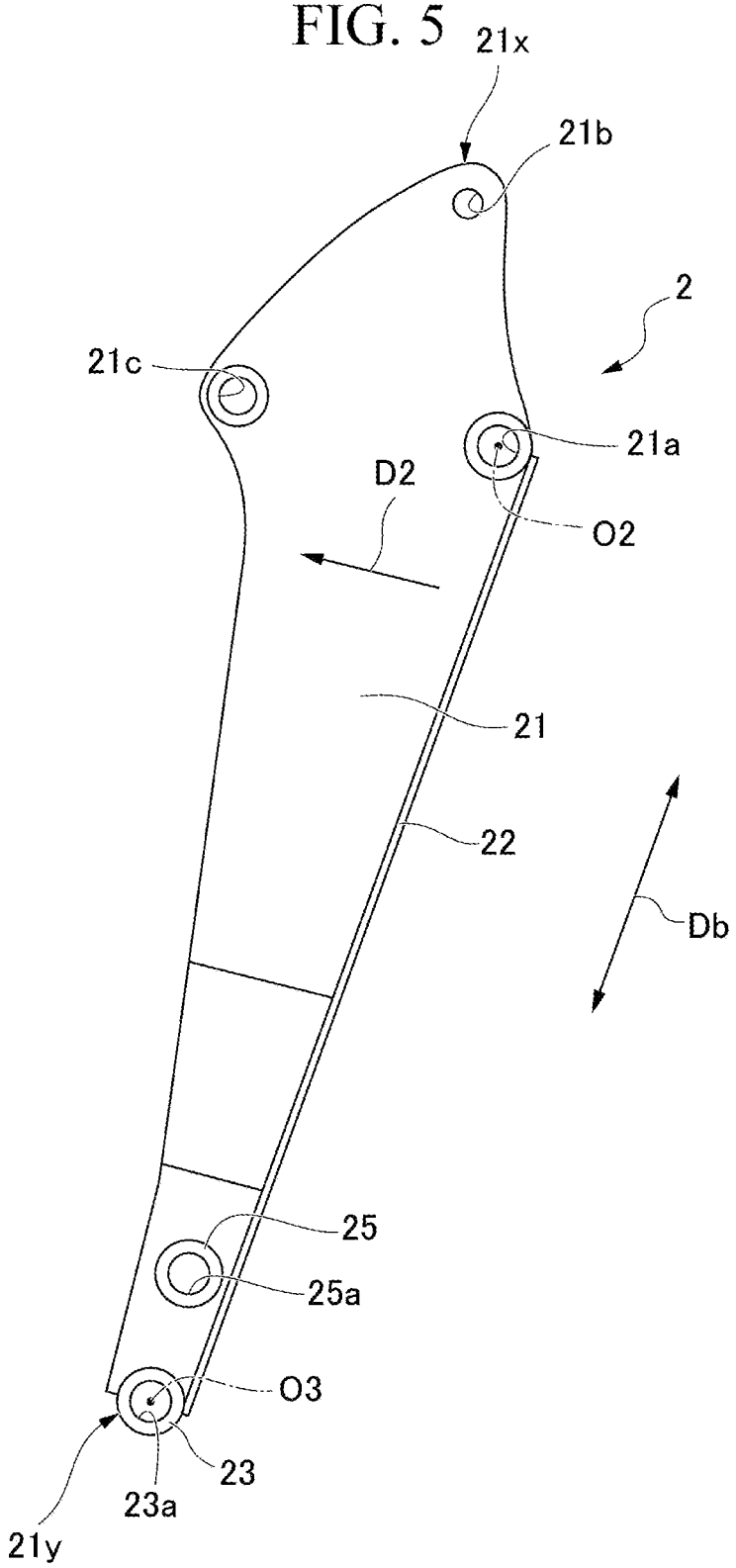
FIG. 5 is a side view of the arm of the excavator according to the embodiment of the present invention.
Figure 6:
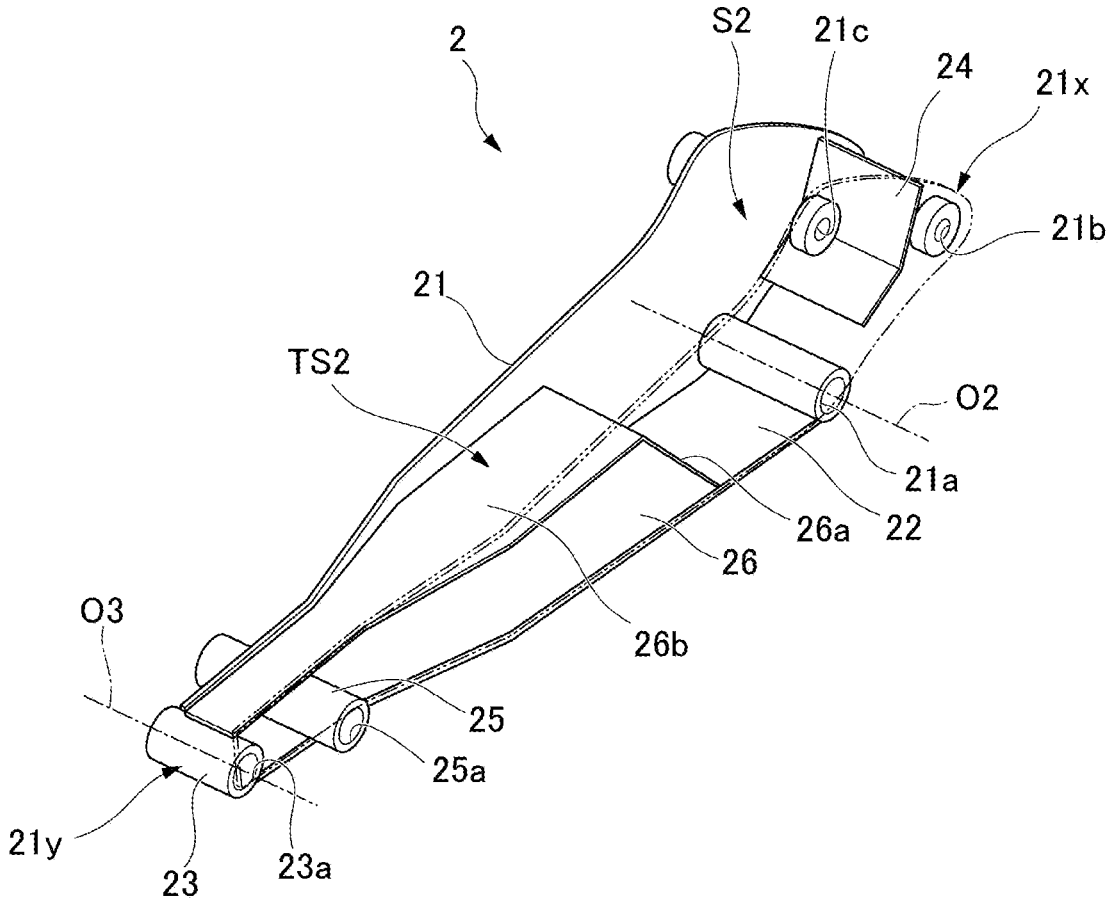
FIG. 6 is a perspective view of the arm of the excavator according to the present invention and a view showing an inside of the arm in a transparent manner.

As shown in FIG. 2, FIG. 5, and FIG. 6, the arm 2 includes: a pair of arm lateral plates 21 extending in a direction away from the arm support portion 16 of the tip end portion 12*y* of the boom lateral plate 12; an arm bottom plate 22 connecting the pair of arm lateral plates 21 to each other; and a work tool support portion 23 provided on the arm lateral plates 21 and supporting the bucket 3 as a work tool. The arm 2 further includes an arm partition member 24 that connects the pair of arm lateral plates 21 to each other.

<Arm Lateral Plate>

As shown by FIG. 5 and FIG. 6, the pair of arm lateral plates 21 are arranged to face each other at an interval in the direction of the second central axis O2, that is, in the width direction of the upper swing body 111. The arm lateral plate 21 extends in a direction (extending direction Db) away from the tip end portion of the boom 1. A base end portion 21*x* of the pair of arm lateral plates 21, which is on the tip end portion side of the boom 1, is provided with a boom connection hole 21*a* penetrating in the width direction of the upper swing body 111. The boom connection hole 21*a* is provided at a position adjacent to the arm bottom plate 22. The second pin P2 is inserted into the boom connection hole 21*a*.

As shown in FIG. 5, an actuator connection hole 21*b* penetrating in the width direction of the upper swing body 111 is provided at a position closer to an upper edge portion of the arm lateral plate 21 than the boom connection hole 21*a*, that is, an edge portion on a side away from the arm bottom plate 22, and further on the base end portion 21*x* side of the arm lateral plate 21 than the boom connection hole 21*a*. In parallel with the actuator connection hole 21*b*, a third actuator hole 21*c* penetrating the arm lateral plate 21 in the width direction of the upper swing body 111 is provided. The third actuator hole 21*c* is provided at a position close to the upper edge portion of the arm lateral plate 21 with respect to the boom connection hole 21*a*.

In each arm lateral plate 21, a size in a vertically provided direction from the arm bottom plate 22 (a plate width size) gradually increases from a position where the actuator connection hole 21*b* of the base end portion 21*x* is provided toward the tip end portion 21*y*, and then gradually decreases. The boom connection hole 21*a* and the third actuator hole 21*c* are provided at a position where the plate width size is the largest in the arm lateral plate 21.

As shown in FIG. 2, the pair of arm lateral plates 21 are sandwiched by the pair of arm support portions 16, and the second pin P2 is inserted into the boom connection hole 21*a* and the second through hole 16*a*; thereby the pair of arm lateral plates 21 is supported by the arm support portions 16 in the boom 1. As a result, the arm 2 is rotatable about the second central axis O2 with respect to the boom 1.

<Work Tool Support Portion>

As shown in FIG. 5 and FIG. 6, the work tool support portion 23 is provided to be disposed between the pair of arm lateral plates 21 on the tip end portion 21*y* of the arm lateral plate 21. The work tool support portion 23 is provided with a third through hole 23*a* penetrating in the width direction of the upper swing body 111. A third pin P3 extending in the width direction is inserted into the third through hole 23*a*. A rotation center of the third pin P3 is referred to as a third central axis O3. Adjacent to the third through hole 23*a*, a link support portion 25 is provided closer to the base end portion 21*x* side of the arm lateral plate 21 than the third through hole 23*a* so as to protrude in a direction away from each of the pair of arm lateral plates 21. The link support portion 25 is provided with a first link connection hole 25*a* extending in parallel with the third through hole 23*a*.

<Arm Bottom Plate>

The arm bottom plate 22 has a flat plate shape as shown in FIG. 5 and FIG. 6. The arm bottom plate 22 connects the pair of arm lateral plates 21 to each other. Specifically, the pair of arm lateral plates 21 are provided integrally with the arm bottom plate 22 at both edge portions of the arm bottom plate 22 in the direction in which the third central axis O3 extends, that is, in the width direction. The arm bottom plate 22 is provided along the extending direction Db of the arm lateral plate 21. In a state in which the entire arm 2 is disposed along the vertical direction, the arm lateral plate 21 is vertically provided from the arm bottom plate 22 in a direction away from the upper swing body 111. Hereinafter, a direction in which the arm lateral plate 21 is vertically provided from the arm bottom plate 22 is referred to as a second direction D2. The second direction D2 is a direction intersecting the extending direction Db.

As shown in FIG. 6, from the arm bottom plate 22, a tip end convex portion 26 which protrudes in the vertically provided direction of the arm lateral plate 21, that is, in the second direction D2, on the tip end portion 21*y* side of the arm lateral plate 21, and connects the pair of arm lateral plates 21 to each other is provided to be across from a central portion in the extending direction Db of the arm lateral plate 21 to the tip end portion 21*y*. The tip end convex portion 26 is provided integrally with the arm bottom plate 22 and the arm lateral plates 21 by joining a plate-shaped member to the arm bottom plate 22 and the arm lateral plates 21 by welding or the like. Therefore, the tip end convex portion 26 is provided on the arm bottom plate 22 so as to be sandwiched by the pair of arm lateral plates 21.

As shown in FIG. 6, the tip end convex portion 26 is provided with an inclination surface 26*a* at a position close to the center portion in the extending direction Db of the arm lateral plate 21 and the inclination surface 26*a* is inclined toward the tip end portion 21*y* of the arm lateral plate 21 while separating away in the second direction D2 from the arm bottom plate 22. The tip end convex portion 26 further includes an upper surface 26*b* having a flat shape, being bent or curved, and being continuous from the inclination surface 26*a*. The upper surface 26*b* is disposed on a side closer to the arm bottom plate 22 than the upper edge portion of the arm lateral plate 21, that is, an edge portion on a side away from the arm bottom plate 22 in the second direction D2. As a result, a tip end-side space TS2 is formed on the second direction D2 side of the upper surface 26*b*, being sandwiched by the upper surface 26*b* of the tip end convex portion 26 and the pair of arm lateral plates 21.

Here, a space that is surrounded by the arm bottom plate 22 and the pair of arm lateral plates 21 and formed on the second direction D2 side of the arm bottom plate 22 between the inclination surface 26*a* of the tip end convex portion 26 and the arm partition member 24 is referred to as an arm internal space S2.

<Arm Partition Member>

The arm partition member 24 has a plate shape as shown in FIG. 6. As shown in FIG. 2 and FIG. 6, the arm partition member 24 connects the pair of arm lateral plates 21 to each other. The arm partition member 24 is provided at a position separated from the arm bottom plate 22, and partitions the arm internal space S2 in the middle of the extending direction Db. The arm partition member 24 has a V-letter plate shape that extends so as to direct toward the base end portion 21*x* of the arm lateral plate 21 while separating away from the arm bottom plate 22 and then to be bent or curved to the tip end portion 21*y* side while directing toward the base end portion 21*x* (see FIG. 2).

<Bucket>

The bucket 3 as the work tool is provided with a work tool through hole 31*a* penetrating in the width direction of the upper swing body 111 as shown in FIG. 1 and FIG. 2. Further, the bucket 3 is provided with a second link connection hole 31*b* extending in parallel with the work tool through hole 31*a* at a position adjacent to the work tool through hole 31*a* and away from the tip end portion 21*y* of the arm lateral plate 21 with respect to the work tool through hole 31*a*.

The third pin P3 is inserted into the work tool through hole 31*a* together with the third through hole 23*a* of the work tool support portion 23 in the arm 2; thereby the bucket 3 is supported so as to be rotatable about the third central axis O3 with respect to the arm 2.

<First Actuator>

The first actuator 4 has a rod shape that expands and contracts along an extending direction of the boom 1 as shown in FIG. 2. Although not shown in detail, the first actuator 4 has a structure using, for example, a ball screw. A first end of the first actuator 4 is connected to the first hole 130*a* of the bracket 130 by a pin Pa, and is supported by the upper swing body 111 via the bracket 130 so as to be rotatable about a central axis extending in the width direction of the upper swing body 111 with respect to the bracket 130.

A second end of the first actuator 4 is connected to the first actuator hole 12*a* of the boom 1 by a pin Pb, and is supported by the boom 1 so as to be rotatable about a central axis extending in the width direction of the upper swing body 111 with respect to the boom 1. As a result, the first actuator 4 is disposed closer to the base end portion 12*x* side of the boom lateral plate 12 than the boom partition member 17.

<First Electric Motor>

The first electric motor 5 is provided adjacent to the first actuator 4 as shown in FIG. 2, and operates the first actuator 4 using the above-described battery as a power source. By operating the first actuator 4 by the first electric motor 5, the first actuator 4 expands and contracts and the boom 1 rotates around the central axis O1 with respect to the upper swing body 111 of the vehicle main body 110.

In the present embodiment, the first electric motor 5 is disposed at a position closer to the boom bottom plate 13 than the first actuator 4, and is disposed between the boom bottom plate 13 and the first actuator 4. The first electric motor 5 is disposed in the boom internal space S1. A first power transmission mechanism 41 using, for example, a planetary gear mechanism or a pulley is provided between the first electric motor 5 and the first actuator 4.

In the present embodiment, the first power transmission mechanism 41 is provided at the second end of the first actuator 4, and the first electric motor 5 is disposed on the second end side of the first actuator 4. A wiring 42 extends from the first electric motor 5. The wiring 42 extends along the inclination surface 19*a* and the upper surface 19*b* of the base end convex portion 19 of the boom 1, and is connected to a power source (not shown) provided in the upper swing body 111 through an inside of the bracket 130. Therefore, the wiring 42 is disposed in the boom internal space S1 and the base end-side space PS1. Here, the first electric motor 5 is always disposed in the boom internal space S1 regardless of a posture of the boom 1. The first electric motor 5 and the wiring 42 are disposed closer to the base end portion 12*x* side of the boom lateral plate 12 than the boom partition member 17.

<Second Actuator>

The second actuator 6 has a configuration similar to that of the first actuator 4 as shown in FIG. 2. A first end of the second actuator 6 is connected to the second actuator hole 12*b* of the boom 1 by a pin Pc, and is supported by the boom 1 so as to be rotatable about the central axis extending in the width direction of the upper swing body 111 with respect to the boom 1.

A second end of the second actuator 6 is connected to the actuator connection hole 21*b* of the arm 2 by a pin Pd, and is supported by the arm 2 so as to be rotatable around a central axis extending in the width direction of the upper swing body 111 with respect to the arm 2. Thus, the second actuator 6 is disposed closer to the tip end portion 12*y* side of the boom lateral plate 12 than the boom partition member 17.

<Second Electric Motor>

The second electric motor 7 has a configuration similar to that of the first electric motor 5, is provided adjacent to the second actuator 6 as shown in FIG. 2, and operates the second actuator 6 using the above-described battery as a power source. By operating the second actuator 6 by the second electric motor 7, the second actuator 6 expands and contracts and the arm 2 rotates about the second central axis with respect to the boom 1.

In the present embodiment, the second electric motor 7 is disposed at a position closer to the boom bottom plate 13 than the second actuator 6, and is disposed between the boom bottom plate 13 and the second actuator 6. The second electric motor 7 is disposed in the boom internal space S1. A second power transmission mechanism 44 is provided between the second electric motor 7 and the second actuator 6. The second power transmission mechanism 44 has the same configuration as the first power transmission mechanism 41.

In the present embodiment, the second power transmission mechanism 44 is provided at the first end of the second actuator 6, and the second electric motor 7 is disposed on the first end side of the second actuator 6. A wiring 45 extends from the second electric motor 7. The wiring 45 extends toward the first electric motor 5 along the inclination surface 19*a* and the upper surface 19*b* of the base end convex portion 19 of the boom 1 together with the wiring 42 of the first electric motor 5, and is connected to a power source (not shown) provided in the upper swing body 111 through the inside of the bracket 130. Therefore, the wiring 45 is disposed in the boom internal space S1 and the base end-side space PS1. Here, the second electric motor 7 is always disposed in the boom internal space S1 regardless of the posture of the arm 2. The second electric motor 7 and the wiring 45 are disposed closer to the tip end portion 12*y* side of the boom lateral plate 12 than the boom partition member 17, and the second electric motor 7 and the first electric motor 5 are provided at positions close to each other in the boom internal space S1.

<Third Actuator>

As shown in FIG. 2, the third actuator 8 has the same configuration as the first actuator 4 and the second actuator 6. A first end of the third actuator 8 is connected to the third actuator hole 21*c* of the arm 2 by a pin Pe. Therefore, the third actuator 8 is supported by the arm 2 so as to be rotatable about the central axis extending in the width direction of the upper swing body 111 with respect to the arm 2.

A first link member 51 is provided at a second end of the third actuator 8. A first link through hole 51*a* penetrating in the width direction of the upper swing body 111 is provided at the first end of the first link member 51. The second end of the third actuator 8 is connected to the first link through hole 51*a* by a pin Pf. Therefore, the third actuator 8 supports the first link member 51 so as to be rotatable about a central axis extending in the width direction of the upper swing body 111 with respect to the first link member 51.

The second end of the first link member 51 is provided with a second link through hole 51*b* penetrating in the width direction of the upper swing body 111. The second link through hole 51*b* is connected to the first link connection hole 25*a* of the arm 2 by a pin Pg. Therefore, the first link member 51 is supported by the arm 2 so as to be rotatable about the central axis extending in the width direction of the upper swing body 111 with respect to the arm 2.

The third actuator 8 is provided with a second link member 52. A third link through hole 52*a* penetrating in the width direction of the upper swing body 111 is provided at the first end of the second link member 52. The third link through hole 52*a* is connected to the second end of the third actuator 8 and the first link through hole 51*a* by a pin Pf. Therefore, the second link member 52 is provided so as to be rotatable about a central axis extending in the width direction of the upper swing body 111 with respect to the second end of the third actuator 8 and the first link member 51.

Further, the second end of the second link member 52 is provided with a fourth link through hole 52*b* penetrating in the width direction of the upper swing body 111. The fourth link through hole 52*b* is connected to the second link connection hole 31*b* of the bucket 3 by a pin Ph. Therefore, the second link member 52 is provided so as to be rotatable about a central axis extending in the width direction of the upper swing body 111 with respect to the bucket 3. The third actuator 8 is disposed closer to the tip end portion 21*y* side of the arm lateral plate 21 than the arm partition member 24.

<Third Electric Motor>

The third electric motor 9 has the same configuration as the first electric motor 5 and the second electric motor 7, is provided adjacent to the third actuator 8 as shown in FIG. 2, and operates the third actuator 8 using the above-described battery as a power source. By operating the third actuator 8 by the third electric motor 9, the third actuator 8 expands and contracts and the bucket 3 rotates about the central axis O3 with respect to the arm 2 by the first link member 51 and the second link member 52.

In the present embodiment, the third electric motor 9 is disposed at a position closer to the arm bottom plate 22 than the third actuator 8, and is disposed between the arm bottom plate 22 and the third actuator 8. The third electric motor 9 is disposed in the arm internal space S2. A third power transmission mechanism 47 is provided between the third electric motor 9 and the third actuator 8. The third power transmission mechanism 47 has the same configuration as the first power transmission mechanism 41 and the second power transmission mechanism 44.

In the present embodiment, the third power transmission mechanism 47 is provided at the first end of the third actuator 8, and the third electric motor 9 is disposed on the first end side of the third actuator 8. A wiring 48 extends from the third electric motor 9. The wiring 48 extends toward the boom 1 and passes through a passage 18*c* shown in FIG. 4 and provided in the tip end convex portion 18 of the boom 1. Further, the wiring 48 extends toward the first electric motor 5 and the second electric motor 7 along the inclination surface 19*a* and the upper surface 19*b* of the base end convex portion 19 of the boom 1 together with the wirings 42 and 45 of the first electric motor 5 and the second electric motor 7, and is connected to a power source (not shown) provided in the upper swing body 111 through the inside of the bracket 130. Therefore, the wiring 48 is disposed in the boom internal space S1 and the base end-side space PS1. Here, the third electric motor 9 is always disposed in the arm internal space S2 regardless of the posture of the bucket 3. The third electric motor 9 and the wiring 48 are disposed closer to the tip end portion 21*y* side of the arm lateral plate 21 than the arm partition member 24.

<Operation and Effects>

In the excavator 100 having the above-described configuration, the first electric motor 5 is disposed in the boom internal space S1. That is, the first electric motor 5 is provided so as to be surrounded between the pair of boom lateral plates 12 and boom bottom plate 13. Therefore, the first electric motor 5 is not exposed from the boom 1.

As a result, it is possible to prevent the first electric motor 5 from receiving an impact when the excavator 100 is performing work, to continue the work, and to stably operate the excavator 100. Therefore, the reliability of the excavator 100 is improved.

Similarly, the second electric motor 7 is disposed in the boom internal space S1. Therefore, the second electric motor 7 is not exposed from the boom 1, and it is possible to prevent the second electric motor 7 from receiving an impact when the excavator 100 is performing work, thus improving the reliability of the excavator 100.

The third electric motor 9 is disposed in the arm internal space S2. That is, the third electric motor 9 is provided so as to be surrounded between the pair of arm lateral plates 21 and the arm bottom plate 22. Therefore, the third electric motor 9 is not exposed from the arm 2, and it is possible to prevent the third electric motor 9 from receiving an impact when work is performed by the excavator 100, thus improving the reliability of the excavator 100.

Since the first electric motor 5 is disposed between the boom bottom plate 13 and the first actuator 4, the first electric motor 5 can be protected by the first actuator 4. As a result, an impact on the first electric motor 5 can be further avoided.

Similarly, since the second electric motor 7 is disposed between the boom bottom plate 13 and the second actuator 6, the second electric motor 7 can be protected by the second actuator 6. As a result, an impact on the second electric motor 7 can be further avoided.

Since the third electric motor 9 is disposed between the arm bottom plate 22 and the third actuator 8, the third electric motor 9 can be protected by the third actuator 8. As a result, an impact on the third electric motor 9 can be further avoided.

In addition, the first electric motor 5 and the second electric motor 7 are both disposed in the boom internal space S1. As a result, the first electric motor 5 and the second electric motor 7 are provided so as to be close proximity in the central portion in the extending direction of the boom 1. Therefore, maintenance of the first electric motor 5 and the second electric motor 7 can be performed in one place, and maintainability can be improved.

Further, since the boom partition member 17 is provided so as to connect the pair of boom lateral plates 12, the strength of the boom 1 can be improved. That is, the vertically provided size of the boom lateral plate 12 from the boom bottom plate 13 (the size in the first direction D1) is the largest at the central portion in the extending direction Da; however, deflection of the boom lateral plate 12 can be suppressed by providing the boom partition member 17 at that position.

Similarly, since the arm partition member 24 is provided so as to connect the pair of arm lateral plates 21, the strength of the arm 2 can be improved.

Other Embodiment

Although the embodiment of the present invention has been described above, the present invention is not limited thereto and can be appropriately changed without departing from the technical idea of the invention.

For example, the boom 1 may further include a top plate disposed to face the boom bottom plate 13 and connecting the pair of boom lateral plates 12 to each other. In this case, the boom 1 has a box shape with a cover, and the boom internal space S1 is surrounded by the boom bottom plate 13, the boom lateral plates 12, and the top plate, on the left, right, top and bottom thereof. In this case, since the first electric motor 5 and the second electric motor 7 are also surrounded from the vertically provided direction of the boom lateral plate 12, it is possible to further avoid an impact on the first electric motor 5 and the second electric motor 7.

Similarly, the arm 2 may further include a top plate disposed to face the arm bottom plate 22 and connecting the pair of arm lateral plates 21 to each other. In this case, the arm 2 has a box shape with a cover, and the arm internal space S2 is surrounded by the boom bottom plate 13, the boom lateral plates 12, and the top plate, on the left, right, top and bottom thereof. In this case, since the third electric motor 9 is also surrounded from the vertically provided direction of the arm lateral plate 21, it is possible to further avoid an impact on the third electric motor 9.

The position of the first electric motor 5 and the position of the first actuator 4 may be reversed. That is, the first actuator 4 may be provided so as to be sandwiched between the first electric motor 5 and the boom bottom plate 13. The position of the second electric motor 7 and the position of the second actuator 6 may be reversed, and the position of the third electric motor 9 and the position of the third actuator 8 may be reversed. The third electric motor 9 may be exposed from the arm 2.

In embodiment, the excavator 100 has been described as an example of a work machine, but the present invention is not limited thereto. For example, the invention according to the present embodiment may be applied to a crane or a pipe layer that does not include the arm 2. In addition, although an example in which the bucket 3 is provided in the arm 2 has been described as an example of the work tool, the invention according to the present embodiment may be applied to the excavator 100 in which a crushing tool, a cutting machine, or the like is provided in the arm 2 instead of the bucket 3.

INDUSTRIAL APPLICABILITY

According to the work machine of present invention, an impact to the electric motor can be avoided and high reliability is achieved.

REFERENCE SIGNS LIST

1: Boom
2: Arm
3: Bucket
4: First Actuator
5: First Electric Motor
6: Second Actuator
7: Second Electric Motor
8: Third Actuator
9: Third Electric Motor
12: Boom Lateral Plate
12*a*: First Actuator Hole
12*b*: Second Actuator Hole
12*x*: Base End Portion
12*y*: Tip End Portion
13: Boom Bottom Plate
14: Boom Support Portion
14*a*: First Through Hole
16: Arm Support Portion
16*a*: Second Through Hole
17: Boom Partition Member
18: Tip End Convex Portion
18*a*: Inclination Surface
18*b*: Upper Surface
18*c*: Passage
19: Base End Convex Portion

19*a*: Inclination Surface
19*b*: Upper Surface
21: Arm Lateral Plate
21*a*: Boom Connection Hole
21*b*: Actuator Connection Hole
21*c*: Third Actuator Hole
21*x*: Base End Portion
21*y*: Tip End Portion
22: Arm Bottom Plate
23: Work Tool Support Portion
23*a*: Third Through Hole
24: Arm Partition Member
25: Link Support Portion
25*a*: First Link Connection Hole
26: Tip End Convex Portion
26*a*: Inclination Surface
26*b*: Upper Surface
31*a*: Work Tool Through Hole
31*b*: Second Link Connection Hole
41: First Power Transmission Mechanism
42: Wiring
44: Second Power Transmission Mechanism
45: Wiring
47: Third Power Transmission Mechanism
48: Wiring
51: First Link Member
51*a*: First Link Through Hole
51*b*: Second Link Through Hole
52: Second Link Member
52*a*: Third Link Through Hole
52*b*: Fourth Link Through Hole
100: Excavator
110: Vehicle Main Body
111: Upper Swing Body
112: Canopy
113: Hood
114: Rear Portion Support
115: Front Portion Support
121: Undercarriage
122: Crawler
123: Blade
130: Bracket
130*a*: First Hole
130*b*: Second Hole
O1: First Central Axis
O2: Second Central Axis
O3: Third Central Axis
S1: Boom Internal Space
S2: Arm Internal Space
PS1: Base End-Side Space
TS1: Tip End-Side Space
TS2: Tip End-Side Space
P1: First Pin
P2: Second Pin
P3: Third Pin
Pa, Pb, Pc, Pd, Pf, Pg, Ph: Pin
CA: Driving Space
D1: First Direction
D2: Second Direction
Da: Extending Direction
Db: Extending Direction

The invention claimed is:

1. A work machine, comprising:

a vehicle main body;

a boom that has a base end portion supported by the vehicle main body and that extends from the vehicle main body;

a first actuator that connects the boom and the vehicle main body and is configured to rotate the boom with respect to the vehicle main body about a first central axis intersecting with an extending direction of the boom; and a first electric motor that is connected to the first actuator to operate the first actuator, wherein the boom comprises:

a pair of boom lateral plates that is disposed to face each other in a direction of the first central axis; and a boom bottom plate that connects the boom lateral plates to each other, wherein the first electric motor is disposed in a boom internal space surrounded by the pair of boom lateral plates and the boom bottom plate, wherein the first electric motor is disposed between the boom bottom plate and the first actuator, wherein a tip end portion of the boom is provided with a tip end convex portion that protrudes from the boom bottom plate and connects the pair of boom lateral plates, wherein the base end portion of the boom is provided with a base end convex portion that protrudes from the boom bottom plate and connects the pair of boom lateral plates, wherein the boom internal space is formed between the tip end convex portion and the base end convex portion, wherein the tip end convex portion is provided with a first inclination surface and a first upper surface, the first inclination surface being inclined toward a tip end portion of the boom lateral plate while separating away from the boom bottom plate, the first upper surface having a flat shape, being bent or curved from the first inclination surface, and continuously directed to the tip end portion of the boom lateral plate, wherein the first upper surface of the tip end convex portion is disposed closer to the boom bottom plate than an upper edge portion of the boom lateral plate, wherein the base end convex portion is provided with a second inclination surface and a second upper surface, the second inclination surface being inclined toward a base end portion of the boom lateral plate while separating away from the boom bottom plate, the second upper surface having a flat shape, being bent or curved from the second inclination surface, and continuously directed to the base end portion of the boom lateral plate, and wherein the second upper surface of the base end convex portion is disposed closer to the boom bottom plate than an upper edge portion of the boom lateral plate.

2. The work machine according to claim 1, further comprising:

an arm that is supported by the tip end portion of the boom and that extends from the tip end portion;

a second actuator that connects the boom and the arm and is configured to rotate the arm about a second central axis intersecting with an extending direction of the arm; and a second electric motor that is configured to operate the second actuator, wherein the second electric motor is disposed in the boom internal space.

3. The work machine according to claim 2, wherein the second electric motor is disposed between the boom bottom plate and the second actuator.

4. The work machine according to claim 3, further comprising:

a work tool supported by the arm;

a third actuator that connects the work tool and the arm and is configured to rotate the work tool about a third central axis intersecting with an extending direction of the arm; and a third electric motor configured to operate the third actuator, wherein the arm includes a pair of arm lateral plates arranged to face each other in a direction of the third central axis, and an arm bottom plate connecting the arm lateral plates to each other, wherein the third electric motor is disposed in an arm internal space surrounded by the pair of arm lateral plates and the arm bottom plate.

5. The work machine according to claim 3, wherein the first actuator has a first end connected to the vehicle main body and a second end connected to the boom, and the second actuator has a first end connected to the boom and a second end connected to the arm, wherein the first electric motor is disposed on the second end side of the first actuator, and the second electric motor is disposed on the first end side of the second actuator.

6. The work machine according to claim 5, wherein the tip end portion of the boom is provided with a tip end convex portion that protrudes from the boom bottom plate and connects the pair of boom lateral plates, the base end portion of the boom is provided with a base end convex portion that protrudes from the boom bottom plate and connects the pair of boom lateral plates, and the boom internal space is formed between the tip end convex portion and the base end convex portion.

7. The work machine according to claim 3, wherein the boom further includes a partition member that connects the pair of boom lateral plates to each other and partitions the boom internal space portion in the middle in the extending direction of the boom.

8. The work machine according to claim 2, further comprising:

a work tool supported by the arm;

a third actuator that connects the work tool and the arm and is configured to rotate the work tool about a third central axis intersecting with an extending direction of the arm; and a third electric motor configured to operate the third actuator, wherein the arm includes a pair of arm lateral plates arranged to face each other in a direction of the third central axis, and an arm bottom plate connecting the arm lateral plates to each other, wherein the third electric motor is disposed in an arm internal space surrounded by the pair of arm lateral plates and the arm bottom plate.

9. The work machine according to claim 8, wherein the first actuator has a first end connected to the vehicle main body and a second end connected to the boom, and the second actuator has a first end connected to the boom and a second end connected to the arm, wherein the first electric motor is disposed on the second end side of the first actuator, and the second electric motor is disposed on the first end side of the second actuator.

10. The work machine according to claim 8, wherein the boom further includes a partition member that connects the pair of boom lateral plates to each other and partitions the boom internal space portion in the middle in the extending direction of the boom.

11. The work machine according to claim 2, wherein the first actuator has a first end connected to the vehicle main body and a second end connected to the boom, and the second actuator has a first end connected to the boom and a second end connected to the arm, wherein the first electric motor is disposed on the second end side of the first actuator, and the second electric motor is disposed on the first end side of the second actuator.

12. The work machine according to claim 11, wherein the boom further includes a partition member that connects the pair of boom lateral plates to each other and partitions the boom internal space portion in the middle in the extending direction of the boom.

13. The work machine according to claim 2, wherein the boom further includes a partition member that connects the pair of boom lateral plates to each other and partitions the boom internal space portion in the middle in the extending direction of the boom.

14. The work machine according to claim 1, wherein the boom further includes a partition member that connects the pair of boom lateral plates to each other and partitions the boom internal space portion in the middle in the extending direction of the boom.

* * * * *